United States Patent [19]

Frentrup et al.

[11] Patent Number: 4,797,229

[45] Date of Patent: Jan. 10, 1989

[54] FUNCTIONAL FLUIDS CONTAINING ASSOCIATIVE POLYETHER THICKENERS, CERTAIN DIALKYL-DITHIOPHOSPHATES, AND A COMPOUND WHICH IS A SOURCE OF MOLYBDATE ION

[75] Inventors: Mark A. Frentrup, Dearborn; Joseph R. Gibson, Riverview; James E. Carson, Lincoln Park; Pauls Davis, Gibraltar, all of Mich.

[73] Assignee: BASF Corporation, Parsippany, N.J.

[21] Appl. No.: 678,963

[22] Filed: Dec. 6, 1984

[51] Int. Cl.[4] ..... B01D 17/04; C10M 125/22

[52] U.S. Cl. ..... 252/345; 252/32.7 R; 252/46.6; 252/75; 252/78.5

[58] Field of Search ..... 252/32.7 R, 46.6, 75, 252/78.5, 345

[56] References Cited

U.S. PATENT DOCUMENTS

| | | | |
|---|---|---|---|
| 3,256,184 | 6/1966 | Harting et al. | 252/32.7 R |
| 3,546,324 | 12/1970 | Pollak | 252/32.7 R |
| 4,288,639 | 9/1981 | Camp | 568/625 |
| 4,289,635 | 9/1981 | Schroeck | 252/32.7 R X |
| 4,310,436 | 1/1982 | Camp | 252/78.5 X |
| 4,312,768 | 1/1982 | Nassry et al. | 252/32.7 |
| 4,312,775 | 1/1982 | Panek et al. | 252/316 |
| 4,376,711 | 3/1983 | Shaub | 252/46.6 X |
| 4,390,440 | 6/1983 | Schwartz et al. | 252/78.5 X |
| 4,392,966 | 7/1983 | Schlicht | 252/46.6 X |
| 4,410,434 | 10/1983 | Andress, Jr. et al. | 252/32.7 R |
| 4,411,819 | 10/1983 | Panek et al. | 252/315.1 |
| 4,481,125 | 11/1984 | Holgado | 252/75 |
| 4,491,526 | 1/1985 | Deck | 252/78.5 X |

*Primary Examiner*—John F. Terapane
*Assistant Examiner*—Catherine S. Kilby
*Attorney, Agent, or Firm*—John C. Demeter; Bernhard R. Swick; David L. Hedden

[57] ABSTRACT

The invention relates to thickened fuctional fluids. The functional fluids can be used in hydraulic systems or as metalworking compositions to cool and lubricate surfaces which are in frictional contact during operations such as the turning, cutting, peeling, or grinding of metals.

The functional fluid contains a diluent, a dialkyldithiophosphate, a compound which is a source of molybdate ion, a polyether nonionic surfactant, and an associative polyether thickener.

8 Claims, No Drawings

FUNCTIONAL FLUIDS CONTAINING ASSOCIATIVE POLYETHER THICKENERS, CERTAIN DIALKYL-DITHIOPHOSPHATES, AND A COMPOUND WHICH IS A SOURCE OF MOLYBDATE ION

BACKGROUND OF THE INVENTION

1. Field of the Invention

This invention relates to functional fluids thickened with associative polyether thickeners. In addition to the associative polyether thickener, the fluids also contain a dialkyldithiophosphate, a compound which is a source of molybdate ion, a polyether nonionic surfactant, and other optional ingredients.

2. Description of the Prior Art

It is known to formulate functional fluids with associative polyether thickeners. See, for instance, U.S. Pat. Nos. 4,411,819 and 4,312,768. However, the fluids described in these patents have wear rates of approximately 20 milligrams per hour. Because of the high wear, these fluids are not entirely satisfactory in pumps which may operate at higher pressures (greater than 500 psi).

It is also known that dialkyldithiophosphate and molybdenum containing compounds can be used separately as additives in functional fluids to improve their wear properties. However, these wear additives are not as effective as wear additives when compared to metal dialkykldithiophosphates.

SUMMARY OF THE INVENTION

The invention relates to functional fluids which can be used in hydraulic systems or as metalworking compositions to cool and lubricate surfaces which are in frictional contact during operations such as the turning, cutting, peeling, or the grinding of metals.

The functional fluid comprises:

(a) a dialkyldithiophosphate having the following structural formula:

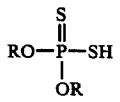

(I)

wherein R is individually a linear or branched alkyl, alkenyl, aryl, arylalkyl, or alkylaryl groups having from 1 to 24 carbon atoms, preferably 6 to 20;

(b) from 0.2 part to 3.0 parts by weight of a sodium or potassium molybdate;

(c) from 0.5 part to 10.0 parts by weight of a polyether nonionic surfactant; and (d) from 0.01 part to 20.0 parts by weight of an associative polyether thickener said weights of components (a), (b), (c), and (d) based upon 1.0 part by weight of the dialkyldithiophosphate; and (e) a diluent in an amount such that from about 60 to 99 percent of the fluid is a diluent.

The subject functional fluids have viscosities which may exceed 200 SUS at 100° F. In the Vickers Vane Pump Test, a widely used test of the antiwear properties of a hydraulic fluid, the fluids showed improved wear rates when compared to functional fluids which contain only a dialkyldithiophosphate or a compound which is a source of molybdate ion.

DESCRIPTION OF THE PREFERRED EMBODIMENTS

The general structure of the dialkyldithiophosphates used in this invention was previously defined by formula I. Particularly useful as the dialkykldithiophosphate is the compound wherein R is 2-ethylhexyl. These additives are well known in the art and are commercially available.

An essential component of the functional fluid is a compound which is a source of molybdate ion such as a sodium or potassium molybdate, ammonium molybdate, and molybdenum trioxide. Such compounds are used in amounts of 0.2 part to 3.0 parts by weight based upon the amount of the dialkyldithiophosphate.

In general, any polyether nonionic surfactant can be used in the practice of this invention provided that it is compatible in water systems with the associative thickener, dialkyldithiophosphate, molybdate, and other ingredients. Such polyether nonionic surfactants are well known in the art. They are prepared by reacting an alkylene oxide with an active hydrogen-containing compound to form a molecule having an average molecular weight of approximately 300 to 10,000, preferably 500 to 5000, and most preferably 500 to 2000, which contains a hydrophobe segment and a hydrophile segment. However, they do not contain a hydrophobe segment based upon an alpha-olefin epoxide or glycidyl ether addition as do the associative thickeners described in a subsequent part of this specification.

Although other polyether nonionic surfactants may work satisfactorily, three groups of surfactants have been shown to work particularly well. The most preferred group consists of polyether nonionic surfactants prepared by reacting a preferably aliphatic alcohol, fatty acid, fatty acid amide, fatty amine initiator (preferably an alcohol initiator) having about 12 to about 18 carbon atoms, preferably about 12 to about 15 carbon atoms, with ethylene oxide to prepare a homopolymer containing the residue of about 5 to about 100 moles of ethylene oxide. Preferably, about 5 to about 20 moles of ethylene oxide are reacted with the initiator to prepare said homopolymer polyether surfactants. Alternatively, block or heteric copolymers can be prepared using as reactants ethylene oxide and a lower alkylene oxide, preferably having 3 to 4 carbon atoms. The residue of ethylene oxide in said polyether copolymer generally is at least about 70 percent by weight when the lower alkylene oxide used with ethylene oxide has 3 carbon atoms. The ethylene oxide residue in the polyether obtained generally is about 80 percent by weight when a lower alkylene oxide containing 4 carbon atoms is utilized with ethylene oxide in the preparation of said ethoxylated surfactant. Preferably, the average molecular weight of said surfactant is about 500 to about 2000. Representative aliphatic alcohol or amine initiators are octadecyl alcohol, stearyl amine, lauryl alcohol, lauryl amine, myristyl alcohol or amine, and cetyl alcohol or amine.

Another preferred group of polyether nonionic surfactants is ethoxylated alkyl phenols having 1 to about 20 carbon atoms in the alkyl group and preferably an average molecular weight of about 400 to about 2000. These are derived from reaction of an alkyl phenol with ethylene oxide to produce a homopolymer. Alternatively, a block or heteric copolymer is prepared by reacting ethylene oxide and a lower alkylene oxide, preferably having 3 to 4 carbon atoms, with an alkyl phenol. The alkyl phenol preferably has about 4 to about 20 carbon atoms in the alkyl side chain. Preferably, the ethoxylated alkyl phenols are derived from the reaction of said alkyl phenol with ethylene oxide or ethylene oxide and at least one lower alkylene oxide, preferably having 3 to 4 carbon atoms, provided that the ethoxylated polyether copolymer surfactant obtained thereby contains at least 50 percent to about 96 percent by weight of ethylene oxide residue. The ethoxylated homopolymer alkyl phenols contain the residue of about 5 to about 100 moles of ethylene oxide. Representative alkyl phenols useful in the preparation of alkoxylated alkyl phenol surfactants are octylphenol, nonylphenol, dodecylphenol, dioctyphenol, dinonylphenol, didodecylphenol and mixtures thereof.

The final group of preferred polyether nonionic surfactants consists of ehylene oxide adducts of sorbitol and sorbitan mono-, di-, and triesters having average molecular weights of 500 to 5000, preferably 500 to 2000. These surfactants are well known in the art. These surfactants are generally prepared by esterifying 1 to 3 moles of a fatty acid and then further reacting with ethylene oxide. The fatty acids usually contain from 10 to 20 carbon atoms, preferably 12 to 18 carbon atoms. Alternatively, a block or heteric copolymer can be prepared by reacting ethylene oxide and a lower alkylene oxide, preferably having 3 to 4 carbon atoms with the fatty acid ester. Preferably the surfactants are prepared by the reaction of the ester with ethylene oxide or ethylene oxide and at least one lower alkylene oxide preferably having 3 to 4 carbon atoms provided that the ethoxylated polyether copolymer surfactant obtained thereby contains from about 20 percent to about 90 percent by weight of ethylene oxide residue. The ethoxylated homopolymers contain the residue of about 5 to about 100 moles of ethylene oxide. They are commercially sold under the INDUSTROL® trademark.

The fluid generally contains about 0.5 to about 10.0 parts by weight of the polyether surfactant, preferably about 0.5 to about 5.0 parts by weight per 1.0 part by weight of the dialkyldithiophosphate.

The associative polyether thickeners which are used in the subject concentrates and functional fluids are relatively new in the art and are disclosed in U.S. Pat. Nos. 4,288,639; 4,312,775; and 4,411,819 which are incorporated herein by reference. These thickeners are prepared by first reacting ethylene oxide or ethylene oxide and generally at least one lower alkylene oxide with at least one active hydrogen-containing compound and subsequently reacting therewith at least one long chain alpha-olefin epoxide or glycidyl ether. The long chain alpha-olefin epoxide or glycidyl ether has a carbon chain length of about 12 to about 18 aliphatic carbon atoms. The proportion of alpha-olefin epoxide or glycidyl ether present in the polyether thickener is generally 1 to about 20 percent by weight, based upon the total weight of the thickener.

The associative polyether polyol thickeners may be readily prepared by modifying a conventional non-associative polyether aqueous thickener by reacting it with an alpha-olefin epoxide or glycidyl ether having about 12 to about 18 carbon atoms or mixtures thereof. The conventional non-associative polyether polyol thickener can be an ethylene oxide-derived homopolymer or a heteric or block copolymer of ethylene oxide and at least one lower alkylene oxide preferably having 3 to 4 carbon atoms. The ethylene oxide is used generally as a reactant in the proportion of at least 10 percent by weight based upon the total weight of the polyether thickener. Preferably, about 60 to 99 percent by weight ethylene oxide is utilized with about 40 to 1 percent by weight of a lower alkylene oxide preferably having 3 to 4 carbon atoms.

The preferred non-associative polyether thickeners used to prepare the associative thickeners are prepared by methods well known in the art. Generally this involves reacting an active hydrogen-containing compound in the presence of an acidic or basic oxyalkylation catalyst and an inert organic solvent at elevated temperatures in the range of about 50° C. to 150° C. under an inert gas pressure, generally from about 20 to about 100 pounds per square inch gauge. Generally, both monohydric and polyhydric alcohol initiators are useful. Useful polyhydric alcohol initiators are selected from the alkane polyols, alkene polyols, alkyne polyols, aromatic polyols, and oxyalkylene polyols. Monohydric alcohol initiators which are useful include aliphatic monohydric alcohols and alkyl phenols containing about 12 to about 18 carbon atoms in the aliphatic or alkyl group. In addition, aliphatic mercaptans having about 12 to about 18 carbon atoms are useful initiators.

In this manner, heteric, block, and homopolymer non-associative polyether thickeners, preferably having average molecular weights of about 1000 to about 60,000, preferably 5000 to 40,000, are prepared which can be used to prepare associative polyether thickeners by reacting them with long chain, aliphatic alpha-olefin epoxides or glycidyl ether.

Generally, about 0.01 part to about 20.0 parts by weight, preferably about 0.5 to about 5.0 parts by weight, of the associative polyether thickener is used per 1.0 part by weight of the dialkyldithiophosphate.

The diluent is water, or a mixture of water and a freezing point lowering additive such that preferably at least 30 percent of the functional fluid is water. Freezing point lowering additives which can be used to replace parts of the water include ethylene glycol, propylene glycol, butylene glycol, diethylene glycol, dipropylene glycol, triethylene glycol, tetraethylene glycol, and the like, or mixtures thereof.

As was mentioned previously, functional fluids may also contain linear or branched alkanolamines having from 2 to 20 carbon atoms. Specific examples of alkanolamines which may be used include: monoethanolamine, diethanolamine, triethanolamine, monoisopropanolamine, diisopropanolamine, triisopropanolamine, di-sec-butanolamine, secbutylaminoethanol, dimethylethanolamine, diethylethanolamine, aminoethylethanolamine, methylethanolamine, butylethanolamine, phenylethanolamine, dibutylethanolamine, monoisopropylethanolamine, diisopropylethanolamine, phenylethylethanolamine, methyldiethanolamine, ethyldiethanolamine, phenyldiethanolamine, dimethylisopropanolamine, 2-amino-2-methyl-1-propanol, and 2-amino-2-ethyl-1,3-propanediol. The alkanolamines are used in amounts of 0.1 part to 20 parts by weight, preferably 0.2 part to 5.0 parts by weight per 1.0 part of the wear additive.

Other optional ingredients which may be used in the subject functional fluids include corrosion inhibitors such as alkali metal nitrites, nitrates, phosphates, silicates and benzoates. Certain amines, other than the alkanolamines previously described, may also be useful. Alkali metal nitrites may also be used when amines are not used. The inhibitors can be used individually or in combinations. Representative examples of the preferred alkali metal nitrates and benzoates which are useful are as follows: sodium nitrate, potassium nitrate, calcium nitrate, barium nitrate, lithium nitrate, strontium nitrate, sodium benzoate, potassium benzoate, calcium benzoate, barium benzoate, lithium benzoate and strontium benzoate.

Representative amine type corrosion inhibitors are morpholine, N-methylmorpholine, N-ethylmorpholine, triethylenediamine, ethylenediamine, triethylenediamine, dimethylaminopropylamine, and piperazine.

Metal deactivators may also be used in the subject functional fluids. Such materials are well known in the art and individual compounds can be selected from the broad classes of materials useful for this purpose such as the various triazoles and thiazoles as well as the amine derivatives of salicylidenes. Representative specific examples of these metal deactivators are as follows: benzotriazole, tolyltriazole, 2-mercaptobenzothiazole, and sodium 2-mercaptobenzothiazole. The corrosion inhibitors and metal deactivators are generally used in amounts of from about 0.001 part to 5.0 parts by weight, preferably 0.1 part to 2.0 parts by weight per 1.0 part of the dialkyldithiophosphate. The examples which follow will illustrate the practice of this invention in more detail. However, they are not intended in any way to limit its scope. All parts, proportions, and percentages are by weight, and all temperatures are in degrees Fahrenheit unless otherwise specified.

The following abbreviations will be used in the Examples:

AMP—2-amino-2-methyl-1-propanol.

Surfactant—an ethylene oxide adduct of a mixture of $C_{12}$–$C_{15}$ alcohols having an average molecular weight of 500 to 600.

Thickener—an associative polyether thickener having an average molecular weight of approximately 17,000 prepared by reacting a mixture of ethylene oxide and propylene oxide (weight ratio of ethylene oxide to propylene oxide of approximately 85:15) to form a heteric intermediate, and then reacting the intermediate with approximately 4 to 5 weight percent of a mixture of $C_{15}$–$C_{18}$ alpha olefin epoxides.

TT—tolyltriazole (50 percent solution).

DDP-1—dialkyldithiophosphate wherein all R groups are 2-ethylhexyl.

DDP-2—dialkyldithiophosphate wherein all R groups are n-hexyl.

MBD—molybdate ion from sodium molybdate.

NaCap—sodium-2-mercaptobenzothiazole.

DIPAE—diisopropyl-2-aminoethanol.

EXAMPLES

Comparative Example A A hydraulic fluid was formulated by mixing 89.09 parts of water with 10.91 parts of a concentrate having the following proportion of ingredients:

| Ingredient | Parts by Weight |
|---|---|
| DIPAE | 1.0 |
| Capric Acid | 0.91 |
| Morpholine | 1.0 |
| DDP-1 | 1.6 |
| Surfactant | 1.0 |
| NaCap | 0.225 |
| $NaNO_3$ | 0.95 |
| Thickener | 4.3 |

The wear rates were then determined by using the Vickers Vane Pump Test. The hydraulic circuit and equipment used were as specified in ASTM D2882 and D2271.

The Vickers Vane Pump Test procedure used herein specifically requires charging the system with five gallons of the test fluid and running at a temperature of 100° F. and at 800 psi pump discharge pressure (load). Wear data were made by weighing the cam-ring and the vanes of the "pump cartridge" before and after the test. At the conclusion of the test run and upon disassembly for weighing, visual examination of the system was made for signs of deposits, varnish, corrosion, etc.

The wear rate for the fluid used in this comparison example was 18 mg/hour over 186 hours of operation.

Example 1

In order to show the effect of adding a molybdate ion to the formulation in Comparison Example A, a hydraulic fluid was prepared by adding 1.0 part of sodium molybdate to the fluid described in Comparison Example A. In each case the amount of water used in Comparison Example A was reduced by the amount of molybdate used so that the amounts of all ingredients are based upon 100 parts of fluid. In this example, 90.0 parts of water was used, so that all ingredients are based upon 100 parts of fluid.

The wear rate was 7 mg/hour over 93 hours of operation.

Comparison Example B

The fluid of Example 1 was tested except that 1.0 part of borate in the form of borax was used instead of molybdate ion. The wear rate was 17 mg/hour over 93 hours of operation.

Comparison Examples A and B along with Example 1 indicate that for the subject fluids, the presence of molybdate ion improves the wear rate of a fluid containing a dialkyldithiophosphate while the presence of borate does not.

Example 2

Another fluid was prepared according to Example 1 having the following components:

| Component | Anount (pbw) |
|---|---|
| TT | 0.5 |
| AMP | 0.6 |
| DDP-1 | 1.6 |
| Surfactant | 1.0 |
| Thickener | 4.2 |
| MBD | 1.0 |
| Water | 91.0 |

The wear rate was 7 mg/hour over 357 hours of operation.

Comparison Example C

Example 2 was duplicated except only 0.1 part of MBD was used. The wear rate was 32 mg/hour for 21 hours.

The embodiments of the invention in which an exclusive privilege or property is claimed are defined as follows:

1. A functional fluid which comprises (a) a dialkyldithiophosphate having the following structural formula:

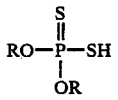

wherein R is individually a linear or branched alkyl, alkenyl, aryl, arylalkyl, or alkylaryl groups having from 1 to 24 carbon atoms;

(b) from 0.2 part to 3.0 parts by weight of a compound which is a soure of molybdate ion;

(c) from 0.5 part to 10.0 parts by weight of a polyether nonionic surfactant; and (d) from 0.01 part to 20.0 parts by weight of an associative polyether thickeners, said weight of components (a), (b), (c), and (d) based upon 1.0 part by weight of the dialkyldithiophosphate; and (e) a diluent in an amount such that from about 60 to about 99 percent of the fluid is water, or a mixture of water and a freezing point lowering additive.

2. The fluid of claim 1 wherein the compound which is the source of the molybdate ion is selected from the group consisting of sodium molybdate, potassium molybdate, ammonium molybdate, and molybdenum trioxide.

3. The fluid of claim 2 wherein R is 2-ethylhexyl. hexyl.

4. The fluid of claim 3 wherein component (b) is used in an amount of 0.3 to 2.0 parts by weight; component (c) is used in an amount of 0.5 part to 5.0 parts by weight; and component (d) is used in an amount of 0.5 part to 5.0 parts by weight, said weights being based upon 1.0 part by weight of the dialkyldithiophosphate.

5. The fluid of claim 4 which contains 0.2 to 5.0 parts by weight of an alkanolamine per 1.0 part of the component (a).

6. The fluid of claim 5 which contains tolyltriazole in an amount of 0.001 part to 2.0 parts by weight per 1.0 part by weight of the dialkyldithiophosphate.

7. The fluid of claim 6 wherein the surfactant is an ethylene oxide adduct of a mixture of $C_{12-15}$ alcohols such that the average molecular weight is from 300 to 5000.

8. The fluid of claim 7 wherein the associative thickener has an average molecular weight of 5000 to 40,000 and is the reaction product of ethylene oxide and propylene oxide in a weight ratio of 3:1 to 10:1 with trimethylol propane which is then reacted with an alpha-olefin epoxide such that the weight percent of alpha-olefin oxide in the associative thickener is from 1 to 20 percent.

* * * * *